United States Patent [19]

Labounty

[11] Patent Number: 4,907,356

[45] Date of Patent: Mar. 13, 1990

[54] SLIPPER BUCKET FOR GRAPPLE

[76] Inventor: Kenneth R. Labounty, Route 1, Box 164B, Two Harbors, Minn. 55616

[21] Appl. No.: 299,639

[22] Filed: Jan. 23, 1989

[51] Int. Cl.[4] ..... E02F 3/76; B66C 3/16

[52] U.S. Cl. ..... 37/117.5; 37/183 R; 37/DIG. 3; 37/DIG. 12; 414/723; 414/724; 294/68.23

[58] Field of Search ..... 37/117.5, 118 R, 183 R, 37/183 A, DIG. 3, DIG. 12; 414/607, 722, 723, 724; 294/68.23

[56] References Cited

U.S. PATENT DOCUMENTS

| | | | |
|---|---|---|---|
| 3,795,070 | 3/1974 | Bronson et al. | 414/722 X |
| 3,802,731 | 4/1974 | La Bounty | 294/88 |
| 4,248,471 | 2/1981 | La Bounty | 294/88 |
| 4,413,945 | 11/1983 | La Bounty | 414/739 |
| 4,517,755 | 5/1985 | Nicholson | 414/722 X |

*Primary Examiner*—Randolph A. Reese
*Assistant Examiner*—J. Russell McBee
*Attorney, Agent, or Firm*—Palmatier & Sjoquist

[57] ABSTRACT

The present scooper of slipper bucket is attachable to an upper jaw of a grapple connected to the boom structure of a hydraulic excavator. The scooper bucket includes a bucket like rigid enclosure forming a tine receiving opening for receiving a tined jaw of the grapple. The tines of the grapple slide into or are inserted through the opening. Distal tip ends of the tines slide into the holding sockets formed inside the bucket enclosure. A pair of removable hooks affixed to the proximal inner ends of the tines are secured to a shaft mounted to the bucket like enclosure over the tine receiving opening. The scooper bucket is readily connected to the upper jaw and operates to scoop up and remove gravel, dirt or sand.

15 Claims, 2 Drawing Sheets

SLIPPER BUCKET FOR GRAPPLE

The present invention relates to an attachment for a hydraulic excavator and, more particularly, to a scooper bucket attachable to a tined jaw of a grapple on the boom structure of a hydraulic excavator. The bucket is sometimes referred to as a slipper bucket.

BACKGROUND OF THE INVENTION

Grapples are typically utilized for grabbing and loading various types of materials into a truck, and for raking the ground to clear debris off a site. The tines of the grapple are instrumental in such raking operations.

SUMMARY OF THE INVENTION

A feature of the present invention is a scooper bucket attachable to an upper tined jaw of a grapple on the boom structure of a mobile machine such as a hydraulic excavator wherein the upper tined jaw is slipped into the scooper bucket and wherein the scooper bucket includes at least one socket receiving the distal tip end of a tine.

Another feature of the present invention is a scooper bucket having a rigid elongate enclosure means with an open front side for accessing the interior of the enclosure means and with a plate portion being shaped to extend between the tines and along portions of the jaw between the distal tip ends of the tines and the proximal inner ends.

Another feature of the present invention is a slipper bucket having a connector means attachable to a front tines jaw adjacent the proximal inner ends of one of the tines.

An advantage of the present invention is that an operator of a hydraulic excavator with a grapple attachment may quickly mount a bucket on the dipper stick without removing the grapple attachment.

Another advantage of the present invention is that an operator of a hydraulic excavator with a grapple attachment may mount a scooper bucket without physically stepping out of the cab of the hydraulic excavator.

Another advantage of the present invention is that, after the scooper bucket is attached to the dipper stick of a hydraulic excavator, the bucket is simple to operate and operates as well as a conventional bucket attachable directly to the dipper stick of a hydraulic excavator.

Another advantage of the present invention is that the scooper bucket is simple and inexpensive to manufacture.

DETAILED DESCRIPTION OF THE PREFERRED EMBODIMENTS

Figure 1:
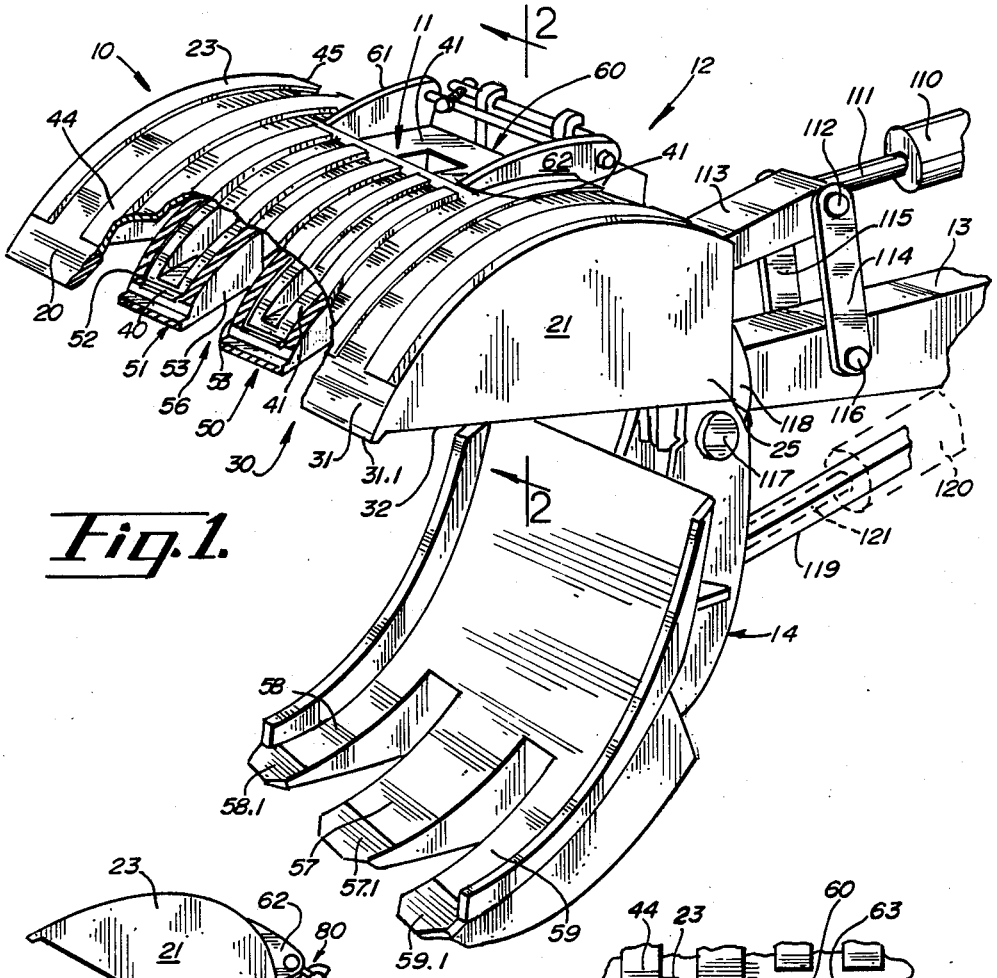
FIG. 1 is a perspective view of a scooper bucket attached to a tined jaw of a grapple mounted on a dipper stick connected to the boom structure of a hydraulic excavator.

A scooper bucket is indicated in general by numeral 10 in FIG. 1 and is attached to an upper tined jaw 11 of a grapple 12. The grapple 12 is mounted on the boom structure of a hydraulic excavator and more specifically on the end of a dipper stick 13 of such a hydraulic excavator. The grapple 12 includes a three tined lower jaw 14. There is no specific requirement as to the nature of the grapple, or the manner of attaching the grapple to the dipper stick.

Figure 2:
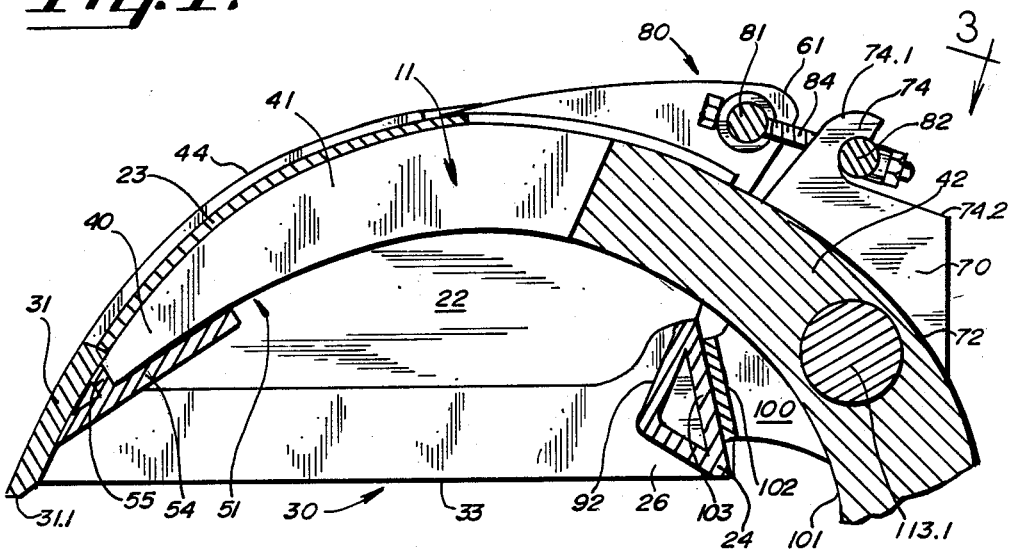
FIG. 2 is a detail section view taken approximately at 2—2 of FIG. 1.

As shown in FIG. 1, the scooper bucket 10 includes a rigid enclosure means 20 having opposite plate ends 21, 22 with an arcuately curved back plate portion 23 welded therebetween. As shown in FIG. 2, a laterally extending triangular box frame 24 is welded between corner portions 25, 26 of respective plate ends 21, 22. The rigid enclosure means 20 is entirely integral and in a one piece fabricated construction wherein all portions are welded together.

The rigid elongate enclosure means 20 includes an open front side 30, as shown in FIG. 2, for accessing the interior of the enclosure means 20. The open front side 30 is defined by a lateral scooper edge portion 31 having a penetrating edge 31.1, longitudinal edge portions 32, 33 of respective plate ends 21, 22, and box frame 24. The open front side 30 is disposed opposite the arcuate back plate 23. The scooper edge portion 31 penetrates a mass of particulate to be scooped such as dirt or sand or a pile of debris.

The arcuately curved back plate portion 23 is shaped to extend from near distal tip ends 40 of a pair of tines 41 of jaw 11 to a rear proximal inner end 42 of top jaw 11 of the grapple 12. A plurality of longitudinal wear strips 44 are welded to the back or top side of the arcuate back plate 23 and extend from a rear end 45 of the arcuate plate 23 to the scooper edge portion 31.

As shown in FIGS. 1 and 2, a pair of tine receiving sockets 50, 51 are formed partially by the inside concave face of the arcuate plate 23 for receiving the tip ends 40 of the tines 41. Each of the tine sockets 50, 51 is formed in part also by a pair of longitudinal substantially triangular side plates 52, 53. Interior side plates 53 are disposed inwardly of exterior side plates 52. A cover plate 54 is affixed to and between the side plates 52, 53 and to the inner face of the scooper edge portion 31 of the arcuate plate 23 to further form the sockets 50, 51. An inner tip abutting plate 55 is affixed between the cover plate 54 and the inner face of the scooper edge portion 31 to complete the sockets 50, 51. Interior side plates 53 of sockets 50, 51 form an opening 56 for reception of a distal tip end 57.1 of a tine 57 of the lower jaw 14. A distal tip end 58.1 of an outer tine 58 may be received between exterior side plates 52 of socket 51 and scooper plate end 22 and a distal tip end 59.1 of an outer tine 59 may be received between exterior side plate 52 of socket 50 and scooper plate end 21.

A rectangular like tine receiving opening 60 is formed in a middle, rear portion of the arcuate plate 23. The tine receiving opening 60 is defined in part by a pair of longitudinally disposed apertured support ears 61, 62, a lateral front edge 63, and the box frame 24.

The tine receiving opening 60 typically receives two tines such as the tines 41. A pair of hooked fin plate portions 70, 71 are affixed in accordance with the present invention to each of the respective back face portions 72, 73 of the upper jaw 11. Each of the hooked fins 70, 71 includes a respective upwardly opening hook 74, 75. Each of the hooks 74, 75 includes a respective front oblique edge 74.1, 75.1 and a respective top straight edge 74.2, 75.2.

A connector means 80 connects the ears 61, 62 to the hooked fins 70, 71. The connector means 80 includes a pair of laterally extending shafts 81, 82. Shaft 81 is affixed in and between the apertured ears 61, 62. Shaft 82 is spaced from and affixed to shaft 81 by a pair of bolts 83, 84. Shaft 82 is received by the hooks 74, 75 to connect the scooper bucket 10 to grapple 12 and dipper stick 13. It should be noted that bolt 83 is disposed between fin 71 and ear 62 and bolt 84 is disposed between fin 70 and ear 61. Bolts 83, 84 include respective shaft securing nuts 85, 86.

Figure 4:
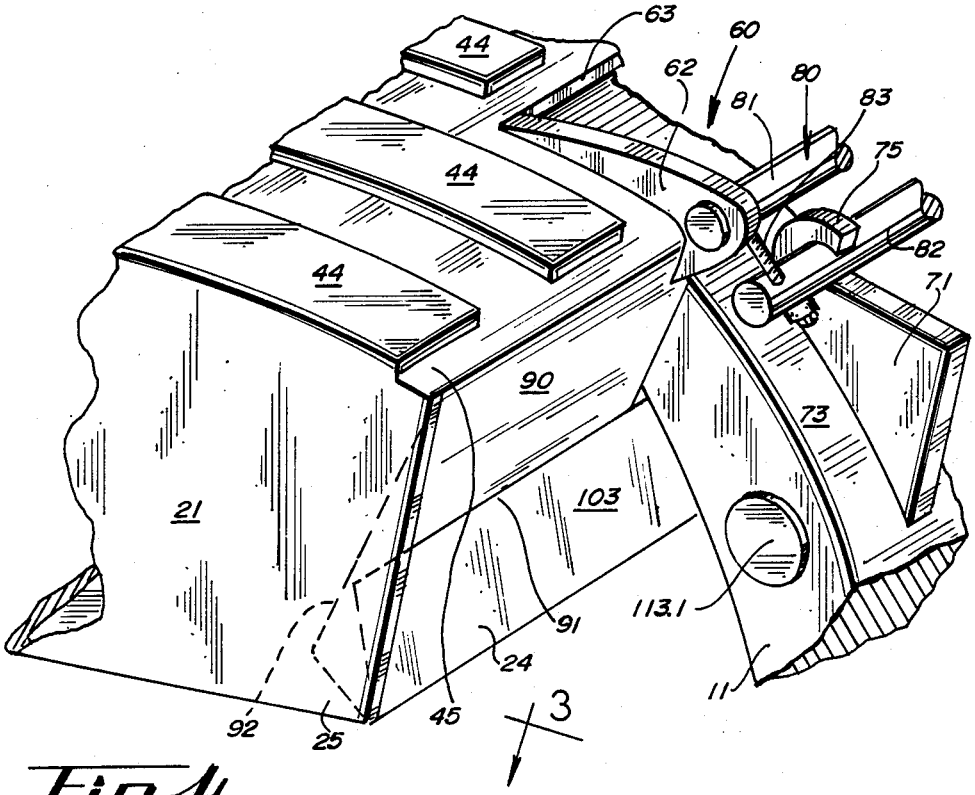
FIG. 4 is a rear perspective view of the scooper bucket shown in FIG. 1.

As shown in FIG. 4, a top plate portion 90 is disposed between rear end 45 of arcuate plate 23, a transverse upper edge 91 of the box frame 24 and the inner face of plate end 21. The plate portion 90 is oriented in substantially the same plane as a plate 92 of the box frame 24. A second top plate portion is disposed in similar fashion as plate 90 between the rear end 45, the upper edge 91 of box frame 24, and the inner face of plate end 22. The top plate portions form part of the tine receiving opening 60.

A box frame abutment ear-like portion 100 extends inwardly from a concave face 101 of the upper jaw 11. The abutment portion 100 includes an abutment plate 102 which bears against a top plate 103 of the box frame 24.

It should be noted that the dipper stick 13 includes a hydraulic cylinder 110 with a ram 111. The ram 111 is connected by a connector pin 112 to ram extension or control link 113 and a pair of support braces or control links 114, 115 which extend to the dipper stick 13 and are connected thereto by a connector pin 116. The ram extension 113 is connectable to a transverse shaft 113.1 connected to the upper jaw 111.

The lower jaw 14 is connected by a connector pin 117 to an inner end 118 of upper jaw 11 and to dipper stick 13. The lower jaw 14 is also connected to the dipper stick 13 by a rigid brace 119. The lower jaw 14 is typically rigidly affixed to the dipper stick 13 and is usually stationary relative to upper jaw 11. However, by replacing rigid brace 119 with a hydraulic cylinder 120 with ram 121, lower jaw 14 may swing relative to the dipper stick 13 and upper jaw 11.

In operation, before the scooper bucket 10 is attached to the upper jaw 11, the grapple 12 and its upper and lower jaws 11, 14 may cooperate to move relatively large objects such as boulders from a construction site. After the larger objects have been cleared from the site, the scooper bucket 10 may be connected to the upper jaw 11 for the removal of relatively small objects such as gravel, dirt or sand.

To attach the bucket 10 to the upper jaw 11, the tines 41 of the upper jaw 11 are inserted into the opening 60 and into sockets 50, 51 until the distal tip ends 40 of the tines 41 bear against tip abutting plate 55 of the sockets 50, 51 and until the plate 102 of the jaw 11 bears against the plate 103 of the box frame 24. During such an insertion of the jaw 11 into the inside of the bucket 10, the bucket 10 may be disposed with its arcuate back plate 23 resting on a surface such as the ground. When the tip ends 40 and the plate 102 have been brought to bear against the tip abutting plate 55 and the box frame plate 103, respectively, the connector 80 is connected to the hooked fins 70, 71 by pivoting connector 80 about shaft 81 until connector shaft 82 bears against top straight edges 74.2, 75.2 of the fins 70, 71. The transverse shaft 82 is then slidingly moved on longitudinal bolts 83, 84 and the shaft securing nuts 85, 86 are tightened therewith until the connector shaft 82 is engaged with hooks 74, 75 of the fins 70, 71. Subsequently, the scooper bucket 10 may be operated to scoop up relatively small objects such as gravel, dirt and sand through opening 30.

During scooping operations, the bucket 10 may be swung relative to the lower jaw 14 by extension of the ram 111 of the hydraulic cylinder 110. Scooper edge portion 31 may dig into gravel, dirt or sand which may be scooped through opening 30 into the enclosure means 20 which is formed in part by the arcuate back plate 23, the end plates 21, 22, the top plates 90 and the box frame 24. As scooper edge portion 31 digs into material such as gravel, dirt, or sand, the distal tip ends 40 of the tines 41 may bear against the tip abutting plate 55 and the inside face of cover plate 54, and the abutment plate 102 of the ear-like tine extension 100 may bear against top plate 103 of the box frame 24.

As the upper jaw 11 swings relative the lower jaw 14, the bucket 10 may swing over portions of the tines of the lower jaw 14. Distal tip end 57.1 of the middle tine 57 of the lower jaw 14 may extend into opening 56 formed by the inside plates 53 of sockets 50, 51. Distal tip ends 58.1, 59.1 may extend between exterior side plate 52 of socket 51 and scooper end plate 22 and exterior side plate 52 of socket 50 and scooper end plate 21, respectively.

The scooper bucket 10 and the lower jaw 14 typically cooperate in raking, lifting, and digging operations. For instance, in raking operations, when the jaws 11, 14 are in an open position, the lower tined jaw 14 may be utilized to rake debris into a pile. The pile of debris may then be scooped up by the scooper bucket 10. The bucket 10 subsequently may scoop up debris of a smaller size which may have passed through the tines of the lower jaw 14. In lifting operations, the scooper bucket 10 and the lower jaw 14 may grab a larger article and lift it into a vehicle such as a dump truck. In digging operations, the penetrating edge portion 31 may dig into the ground. As the bucket 10 fills up of dirt, the jaw 14 holds clumps of dirt in the bucket 10. The bucket 10 may also swing partially over the lower jaw 14 in such digging, lifting, and raking operations wherein the lower jaw 14 effectively packs debris into the bucket 10.

It should be noted that an operator of a hydraulic excavator may attach the bucket 10 to the upper jaw 11 without leaving the cab of the excavator. In such a method of attachment, the bracket 10 may be disposed with its arcuate back plate 23 resting on a surface such as the ground. The tines 41 of the upper jaw 11 are subsequently inserted into the opening 60 formed in the arcuate back plate 23 and between the top plates 90. As the tines 41 are being inserted into the bucket 10, the distal tip ends 40 may slide and bear against the inside concave surface of the arcuate back plate and slide into the sockets 50, 51. While the tines 41 are being inserted through into the sockets 50, 51, the front oblique edges 74.1, 75.1 of the respective hooks 74, 75 may slide against the connector shaft 82. When the tip ends 40 bear against the tip abutting plates 55 and plate 102 of the jaw 11 bears against plate 103 of the bucket 10, the jaw 11 may be moved upwardly. As the jaw 11 is moved upwardly, the connector shaft 82 may fall to rest on the top straight edges 74.2, 75.2 of the hooks 74, 75. The jaw 11 may subsequently be pivoted downwardly so that the bucket 10 slides slightly down the tines 41 until the hooks 74, 75 engage the connector shaft 82. The bucket 10 is then ready for operation.

To remove the bucket 10 from the jaw 11, the bucket 10 is oriented so that the arcuate back plate 23 is resting on a surface such as the ground. The tines 41 are then moved so that their distal tip ends 40 bear against the tip abutting plates 55. As the tip ends 40 move toward plate 55, shaft 82 slides out of hooks 74, 75 on edges 74.2, 75.2 and the connector 80 pivots by gravity about shaft 81 so that connector shaft 82 falls from the edges 74.2, 75.2 and out of engagement with hooks 74, 75. The tines 41 are then removed from opening 60 and out of the bucket 10.

Figure 5:
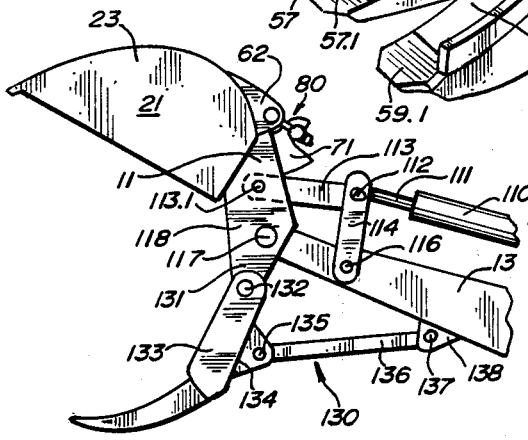
FIG. 5 is a side elevation view of the scooper bucket attached to an alternate type of grapple.
Figure 3:
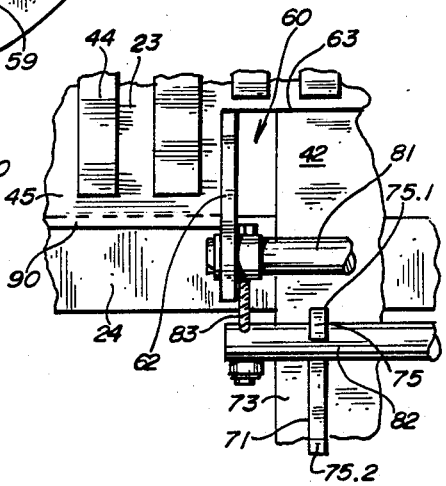
FIG. 3 is a top elevation view from 3—3 of FIG. 2.

As shown in FIG. 5, an alternate type of grapple 140 includes a downwardly extending portion 131 of the inner end 118 of the upper jaw 11. The downwardly extending portion 131 is connected by a connector pin 132 to a lower jaw 133. An ear 134 of the lower jaw 133 is connected by a connector pin 135 to one end of a brace 136. The brace 136 is connected at its other end by a connector pin 137 to an ear 138 affixed to the dipper stick 13 so that the lower jaw is pivotally connected to the underside of the dipper stick 13. In operation, the double acting hydraulic cylinder 110 causes movement of the upper jaw 11, which thereby effects movement of the lower jaw 133 about connector 132, such that the jaws 11, 133 may be moved together for clamping or scooper operations. Grapple 130 may be the type of grapple disclosed in the LaBounty U.S. Pat. No. 4,248,471 issued Feb. 3, 1981 and entitled "Backhoe Grapple Assembly."

I claim:

1. A scooper bucket attachable to a tined jaw of a grapple on the boom structure of a mobile machine such as a hydraulic excavator comprising rigid elongate enclosure means having opposite ends and an open front side for accessing the interior of the enclosure means, the enclosure means also having a plate portion defining at least a partial back side opposite said open front side, said plate portion being shaped to extend along portions of the jaw between the distal tip ends of the tines and the proximal inner ends, the plate portion having an edge portion adjacent the open front side for penetrating a mass of particulate to be scooped, and the enclosure means having a socket for demountably receiving the distal tip end of one tine and also having connector means attachable to the tined jaw adjacent the proximal inner end of one of the tines for demountably securing the enclosure means and scooper bucket to the tined jaw.

2. The scooper bucket according to claim 1 wherein said plate portion is arcuately curved from said edge portion.

3. The scooper bucket according to claim 1 wherein said connector means retains the plate portion against the tines of the jaw.

4. The scooper bucket according to claim 1 wherein said connector means includes a top plate portion with a tine receiving opening, the top plate portion being adapted to retain the plate portion and enclosure means against movement endways of the elongate enclosure means.

5. The scooper bucket according to claim 1 wherein the elongate enclosure means extends endways in both directions from the socket and the jaw tine therein, said ends of the enclosure means being widely spaced from the socket.

6. The scooper bucket according to claim 5 wherein said plate portion also extends endways of the enclosure means and substantially to said opposite ends.

7. The scooper bucket according to claim 1 wherein the enclosure means includes end wall portions at said opposite ends which lie transversely of said open front side.

8. The scooper bucket according to claim 1 wherein the plate portion is shaped to correspond to the shape of the tines of the jaw, the plate portion and tines being smoothly curved.

9. The scooper bucket according to claim 1 wherein the plate portion is concavely curved relative to the open front side of the enclosure means.

10. The scooper bucket according to claim 1 wherein said socket includes side plates adapted to retain the plate portion and enclosure means against movement endways of the elongate enclosure means.

11. An implement attachable to the boom structure and hydraulic system of a mobile machine such as a hydraulic excavator, comprising a grapple having a pair of tined grapple jaws having distal tip ends confronting each other and also having proximal inner ends connected together for relative swinging, a scooper bucket demountably secured on one of said jaws, the bucket having enclosure means defining an open front providing access into the inside of the enclosure means, the enclosure means having a plate portion defining a partial back side opposite said open front side, the plate portion having a front edge portion adjacent the open front side for penetrating a mass of particulate to be scooped, and the plate portion also having a rear edge portion, the enclosure means having an opening adjacent said rear edge portion and receiving a portion of one of the tined jaws therethrough, the jaw extending substantially to said front edge portion, the enclosure means including a socket means adjacent the front edge portion and receiving the distal tip end of said one tined jaw therein, and connector means between the jaw and enclosure means adjacent the rear edge portion of said plate portion.

12. The scooper bucket according to claim 11 wherein one of the jaws is swingable, the bucket being secured on said swingable jaw.

13. The scooper bucket according to claim 12 and including means producing swinging of said swingable jaw, and the other jaw having means controlling the position thereof independently of said swingable jaw.

14. The scooper bucket according to claim 11 wherein both of the jaws are swingable.

15. A scooper bucket attachable to a tined jaw of a grapple on the boom structure of a mobile machine such as a hydraulic excavator comprising rigid elongate enclosure means having opposite ends and an open front side for allowing access to the interior of the enclosure means, the enclosure means also having a plate portion defining at least a partial back side opposite said open front side, said plate portion being shaped to extend along portions of the jaw between the distal tip ends of the tines and the proximal inner ends, the plate portion having an edge portion adjacent the open front side for penetrating a mass of particulate to be scooped, the plate portion being arcuately curved from said edge portion, the rigid elongate enclosure means including a pair of end plate portions, a lateral box frame portion, and a top plate portion, the top plate portion being disposed opposite the edge portion, the end plate portions being disposed opposite each other and between the edge portion and the top plate portion, the arcuate plate portion extending to the lateral box frame portion and end plate portions, the arcuate back plate portion forming a tine receiving opening for allowing the tined jaw to have access to the interior of the enclosure means, the arcuate back plate portion having a lateral hook receiving shaft affixed thereto and across the tine receiving opening, the enclosure means having a pair of sockets for receiving distal tip ends of the tines of the tined jaw, the sockets being formed by socket plate portions affixed to the inside face of the arcuate plate portion, the sockets forming a middle tine receiving opening between each other for receiving a distal tip end of a middle tine of a lower jaw of the grapple, the sockets also forming with the end plate portions a pair of outer tine receiving openings for receiving distal tip ends of outer tines of the lower jaw of the grapple, and connector means attachable to the tined jaw and including a pair of hooked plate portions and an abutment plate portion, the hooked plate portions being affixed to one side of the tined jaw and the abutment plate portion being affixed to the other side of the tined jaw, the hooked plate portions receiving the lateral shaft affixed to the arcuate back plate portion, the abutment plate bearing against the box frame portion whereby the sockets and connector means cooperate to connect the grapple to the scooper bucket for scooping like operations.

* * * * *

UNITED STATES PATENT AND TRADEMARK OFFICE

CERTIFICATE OF CORRECTION

PATENT NO. : 4,907,356

DATED : March 13, 1990

INVENTOR(S) : Kenneth R. LaBounty

It is certified that error appears in the above-identified patent and that said Letters Patent is hereby corrected as shown below:

On the title page, item [19] and [76] change the spelling of the inventor's last name from "Labounty" to --LaBounty--.

Signed and Sealed this

Fourteenth Day of January, 1992

*Attest:*

*Attesting Officer*

HARRY F. MANBECK, JR.

*Commissioner of Patents and Trademarks*